US007825944B2

(12) United States Patent
Kaiya

(10) Patent No.: US 7,825,944 B2
(45) Date of Patent: Nov. 2, 2010

(54) RECORDING APPARATUS AND WATERPROOF STRUCTURE FOR THE SAME

(75) Inventor: Mitsuhiro Kaiya, Chiba (JP)

(73) Assignee: Seiko Instruments Inc. (JP)

( * ) Notice: Subject to any disclaimer, the term of this patent is extended or adjusted under 35 U.S.C. 154(b) by 968 days.

(21) Appl. No.: 11/606,586

(22) Filed: Nov. 30, 2006

(65) Prior Publication Data

US 2007/0139505 A1 Jun. 21, 2007

(30) Foreign Application Priority Data

Dec. 15, 2005 (JP) ..... 2005-361528

(51) Int. Cl.
*B65D 65/02* (2006.01)
*B41J 29/13* (2006.01)
*B41J 3/36* (2006.01)
*B41J 2/325* (2006.01)

(52) U.S. Cl. ..... 347/222; 150/165; 347/108; 347/109

(58) Field of Classification Search ..... 347/222
See application file for complete search history.

(56) References Cited

U.S. PATENT DOCUMENTS 5,471,667 A * 11/1995 Yamada ..... 455/351
6,010,067 A * 1/2000 Elbaum ..... 235/380
2006/0078365 A1 * 4/2006 Choh et al. ..... 400/693

FOREIGN PATENT DOCUMENTS

EP 1559563 1/2005
JP 62113577 5/1987

OTHER PUBLICATIONS

Printek, Inc., 2004, Marketing brochure for the Mt2 Series Mobile Printer and the Environmental Case.*

* cited by examiner

*Primary Examiner*—Matthew Luu
*Assistant Examiner*—Kendrick X Liu
(74) *Attorney, Agent, or Firm*—Adams & Wilks

(57) ABSTRACT

A recording apparatus includes a main body for recording on a recording medium, a protective cover which has an opening, for covering the main body with a portion other than the opening of the protective cover, and a waterproof cover which is connected to the protective cover via first and second connecting portions. When the first and second connecting portions are respectively in connected states, the waterproof cover is positioned so that the waterproof cover is opposed to the opening of the protective cover, and there is a gap for passing the recording medium between the protective cover and the waterproof cover. When the first connecting portion is in the connected state and the second connecting portion is in a disconnected state, the waterproof cover is moved to a position so that a part of the main body can be exposed to an outside through the opening.

3 Claims, 6 Drawing Sheets

RECORDING APPARATUS AND WATERPROOF STRUCTURE FOR THE SAME

This application claims priority to Japanese Patent Application No. 2005-361528 filed Dec. 15, 2005, the entire content of which is hereby incorporated by reference.

BACKGROUND OF THE INVENTION

The present invention relates to a recording apparatus such as a printer including a recording portion for effecting recording on a recording medium and a waterproof structure for the recording apparatus.

Conventionally, as recording apparatuses such as a printer including a recording portion for effecting recording on a recording medium, there have been proposed many recording apparatuses of a stationary type installed indoors for use. However, in recent years, a small lightweight recording apparatus and a recording apparatus which can be driven by a power source such as a battery are developed. Further, there is manufactured a recording apparatus not only for effecting recording on the recording medium but also integrated with a calculator, a measuring apparatus, and a display. It is desired, in some cases, that those recording apparatuses be used in various locations while being carried by a user. In this case, there is a problem in that moisture may enter an inside of a recording apparatus main body to induce malfunction. In particular, in a case of the recording apparatus which is desired to be used outdoors, a waterproof measure is essential in the event of rain. The recording apparatus main body including the recording portion for effecting recording on the recording medium is always provided with an outlet for discharging the recording medium. Therefore, a casing itself of the recording apparatus main body cannot be completely sealed. Therefore, there is a high risk of causing the moisture to enter from the outlet.

Here, as described in the documents of JP 07-86426 B, Japanese Utility Model Application Laid-open No. Hei 5-7466, and JP 06-47987 A, there is proposed a structure having a waterproof cover for covering the outlet for the recording medium and a portion around the outlet of the recording apparatus including the recording portion.

In the specification, apparatuses each including the recording portion for effecting recording on the recording medium is collectively referred to as "recording apparatus", inclusive of apparatuses having various functions other than recording.

In each of the structures described in the documents of JP 07-86426 B. Japanese Utility Model Application Laid-open No. Hei 5-7466, and JP 06-47987 A, only an outlet for a recording medium and a portion around the outlet of a recording apparatus main body are covered with a waterproof cover and no waterproof cover is provided for covering other portions. In those structures, it is effective to cover the outlet for the recording medium with the waterproof cover. However, in order to impart waterproof characteristics to other portions, a casing of the recording apparatus main body is required to have a waterproof structure. In other words, according to JP 07-86426 B; Japanese Utility Model Application Laid-open No. Hei 5-7466, and JP 06-47987 A, a sufficient waterproof effect can only be obtained by making the casing of the recording apparatus main body have the waterproof structure different from that of the stationary type and by using the waterproof cover together therewith. That is, the recording apparatus main body to be used is limited to that having the waterproof structure, which is not applicable to various recording apparatus main bodies. In order to provide the recording apparatus main body with the waterproof structure, there are involved complication of the structure of the recording apparatus main body, increase in cost thereof, and complication of manufacturing steps.

In order to obtain the sufficient waterproof effect of the recording apparatus main body, the recording apparatus main body may be accommodated in a rigid waterproof case formed of a synthetic resin or the like. However, in this case, when, for example, maintenance such as charging and replacement of the recording medium or replacement of a battery is required, the maintenance operation cannot be performed unless the recording apparatus main body is taken out of the waterproof case. Further, when the user carries and uses the recording apparatus, there may be no place to temporarily store, during the maintenance operation, the waterproof case from which the recording apparatus main body is taken out. Therefore, the waterproof case becomes an obstacle.

On the other hand, it is desirable that, regarding the recording apparatus which may be carried by the user, damage due to an impact at a time of fall, abutment with other external articles, or the like be prevented as much as possible. As described above, with the structure in which the recording apparatus main body is accommodated in the rigid waterproof case, the recording apparatus has a resistance to an impact from the outside, but there is a risk of the recording apparatus main body moving (causing rattling) inside the rigid waterproof case and receiving the impact due to an abutment with the waterproof case, to thereby be damaged.

SUMMARY OF THE INVENTION

It is therefore an object of the present invention to provide a recording apparatus in which a recording apparatus main body including a recording portion for effecting recording on a recording medium is not required to have a waterproof structure, a sufficient waterproof effect can be obtained by covering an outlet for the recording medium and a portion required to be covered of the recording apparatus main body, maintenance operations such as charging and replacement of the recording medium can be performed with ease, and which has a high impact resistance, and a waterproof structure for the recording apparatus.

According to the present invention, a recording apparatus includes: a recording apparatus main body having a recording portion for effecting recording on a recording medium and an outlet for discharging the recording medium; a protective cover which is formed of a waterproof material and has an opening, for covering the recording apparatus main body with a portion other than the opening of the protective cover; and a waterproof cover which is formed of a waterproof material and is connected to the protective cover via a first connecting portion and a second connecting portion. When the first connecting portion and the second connecting portion are respectively in connected states, the waterproof cover is positioned so that the waterproof cover is partially opposed to the opening of the protective cover, the protective cover and the waterproof cover are provided with a gap therebetween, through which the recording medium can pass, and the waterproof cover and the protective cover an outer surface of the recording apparatus main body having a portion exposed to an outside through the gap. When the first connecting portion is in the connected state and the second connecting portion is in a disconnected state, the waterproof cover is moved to a position not opposed to the opening so that a part of the recording apparatus main body can be exposed to an outside through the opening.

With this construction, it is possible to effectively realize sufficient waterproof characteristics and to smoothly discharge the recording medium discharged from the recording apparatus main body to the outside. By connection and disconnection of the second connecting portion, it is possible to easily switch between a waterproof state of the recording apparatus and a state where a part of the recording apparatus main body is exposed to the outside for the maintenance operation or the like. In that case, the waterproof cover can be left connected to the protective cover via the first connecting portion, so it is not required to separately store the waterproof cover.

The protective cover has a shock absorption, is formed along an outer shape of the recording apparatus main body except the opening, and is adjacent to the outer surface of the recording apparatus main body. With this construction, the recording apparatus main body can be protected from the impact from the outside by the protective cover.

In a portion of the recording apparatus main body which is exposed to the outside through the opening in a state where the waterproof cover is moved to a position not opposed to the opening, there may be arranged a recording medium loading portion and an opening/closing portion capable of covering the recording medium loading portion. In this case, a maintenance operation such as replacement or charging of the recording medium or elimination of a jam of the recording medium is facilitated to a great extent.

It is preferable that the protective cover be flexible, and when the second connecting portion is in the disconnected state and the waterproof cover is moved to the position not opposed to the opening, the recording apparatus main body be fitted into an inside of the protective cover from the opening. In this case, it is possible to easily accommodate the recording apparatus main body in the protective cover while bending the opening and a portion around the opening of the protective cover. Further, it is also possible to reduce a risk of the recording apparatus main body unintentionally falling off from the protective cover.

The first connecting portion serves as a fixing portion for making the protective cover and the waterproof cover undetachable from each other. The second connecting portion may be formed of hook-and-loop fasteners, magnet tapes, or snap fasteners. It is preferable that when the second connecting portion is in the disconnected state, the waterproof cover be allowed to open/close by pivoting about the first connecting portion with respect to the protective cover. With this construction, as described above, it is possible to perform an operation of switching between the waterproof state of the recording apparatus main body and the state where a part of the recording apparatus main body is exposed to the outside through the opening for the maintenance operation with ease and high reliability. Further, in the waterproof state, it is possible to suppress entering of moisture from the first connecting portion and the second connecting portion.

The recording apparatus main body is provided with operating portions. The protective cover has holes opened there in at positions opposed to the operating portions. The waterproof cover may have extension portions for closing the holes. With this construction, a waterproof effect is imparted to the operating portions which is required to be operated by the user and also to portions around those. Further, when the waterproof cover is formed of a transparent or translucent waterproof synthetic resin, the extension portion of the waterproof cover does not become an obstacle to the operation.

The recording apparatus main body is provided with a battery loading portion. The protective cover is provided with a lid capable of opening/closing in a position which is opposed to the battery loading portion. The lid may constitute a waterproof structure for preventing moisture form entering the recording apparatus when the lid is closed. With this structure, loading of the battery can be performed with ease without removing the protective cover and while maintaining the waterproof effect as much as possible.

The waterproof cover may include a guide portion for guiding the recording medium discharged from the outlet to the gap. In this case, discharge of the recording medium to the outside becomes smoother.

The recording apparatus may further include a holder attached to an outer side of the protective cover, for carrying the recording apparatus main body. In this case, it is preferable that the gap be provided in a position located on a lower side of the recording apparatus when the recording apparatus main body which is covered with the protective cover and the waterproof cover is carried using the holder. Consequently, in a normal use environment, there is no need to consider the entry of the moisture from the gap.

According to the present invention, a waterproof structure for the recording apparatus includes: a protective cover which is formed of a waterproof material and has an opening, for covering the recording apparatus main body with a portion other than the opening of the protective cover; and a waterproof cover which is formed of a waterproof material and is connected to the protective cover via a first connecting portion and a second connecting portion. When the first connecting portion and the second connecting portion are respectively in connected states, the waterproof cover is positioned so that the waterproof cover is partially opposed to the opening of the protective cover, the protective cover and the waterproof cover are provided with a gap therebetween, through which the recording medium can pass, and the waterproof cover and the protective cover cover an outer surface of the recording apparatus main body having a portion exposed to an outside through the gap. When the first connecting portion is in the connected state and the second connecting portion is in a disconnected state, the waterproof cover is moved to a position not opposed to the opening so that a part of the recording apparatus main body can be exposed to an outside through the opening.

According to the present invention, even without providing the recording apparatus main body with a special waterproof structure, a sufficient waterproof effect is obtained in the normal use environment, and the recording medium discharged from the recording apparatus main body can be smoothly discharged to the outside. In addition, the recording apparatus main body is protected by the protective cover from the impact from the outside.

Further, when the maintenance operation of the recording apparatus main body is performed, a part of the recording apparatus main body, for example, the recording medium loading portion can be easily exposed to the outside, and the recording apparatus can be easily returned to the waterproof state. At this time, the waterproof cover does not become an obstacle to the operation, and is not required to be stored outside. Therefore, an operability of the recording apparatus is very high.

DETAILED DESCRIPTION OF THE INVENTION

In the following, an embodiment of the present invention will be described with reference to the drawings.

Figure 1:
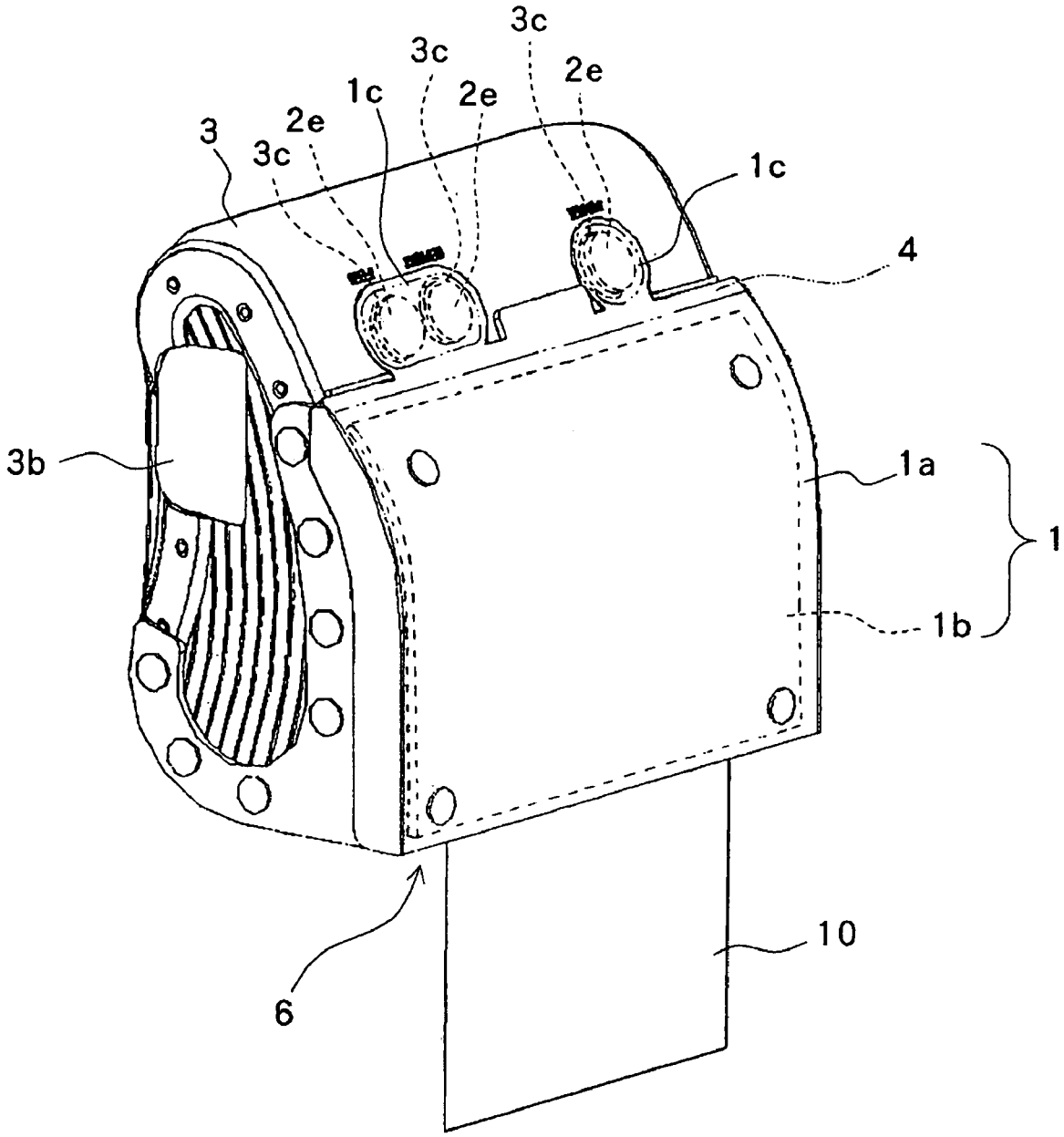
FIG. 1 is a perspective view of a recording apparatus according to the present invention.
Figure 2:
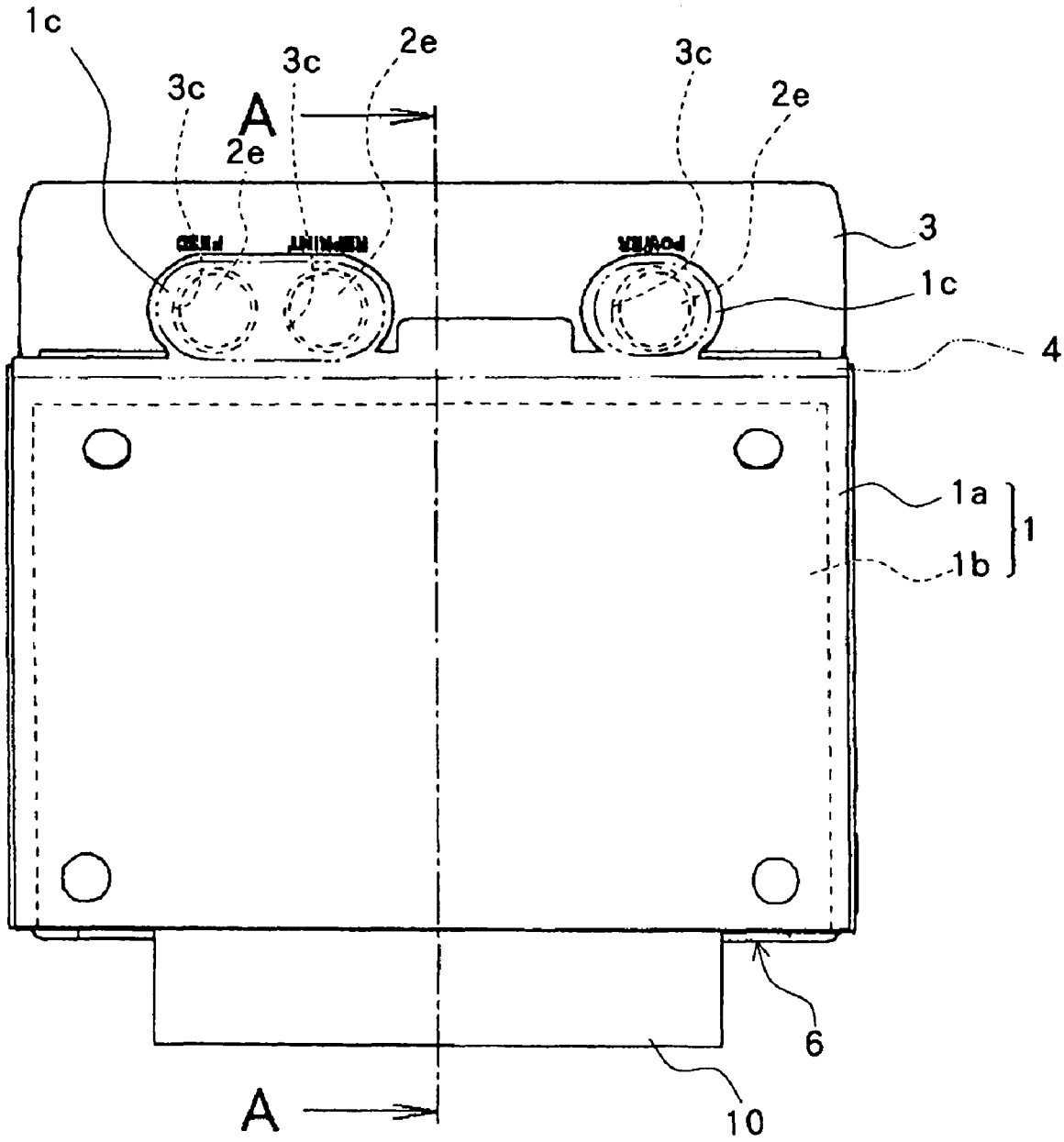
FIG. 2 is a plan view of the recording apparatus shown in FIG. 1.
Figure 3:
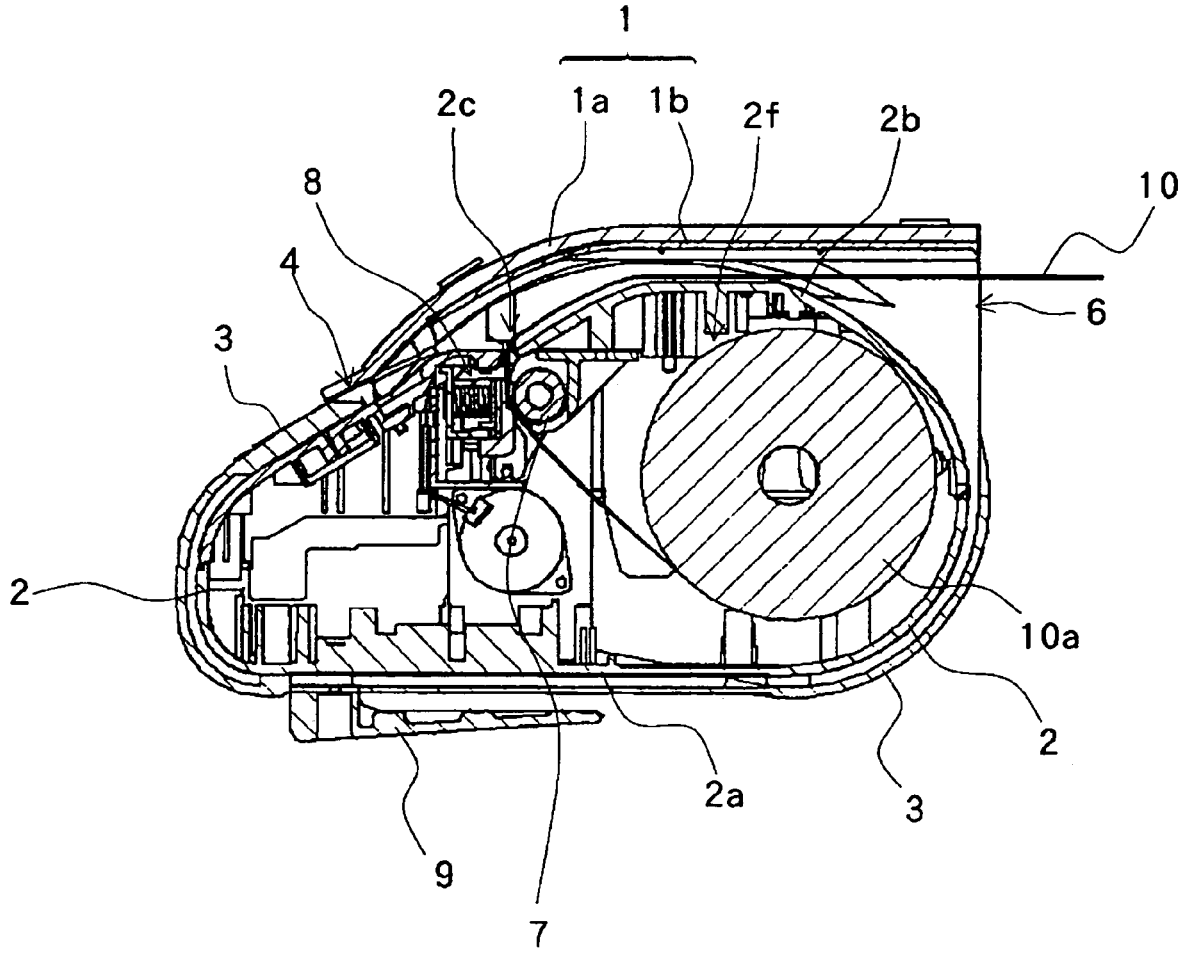
FIG. 3 is a sectional view taken along the line A-A of FIG. 2.
Figure 4:
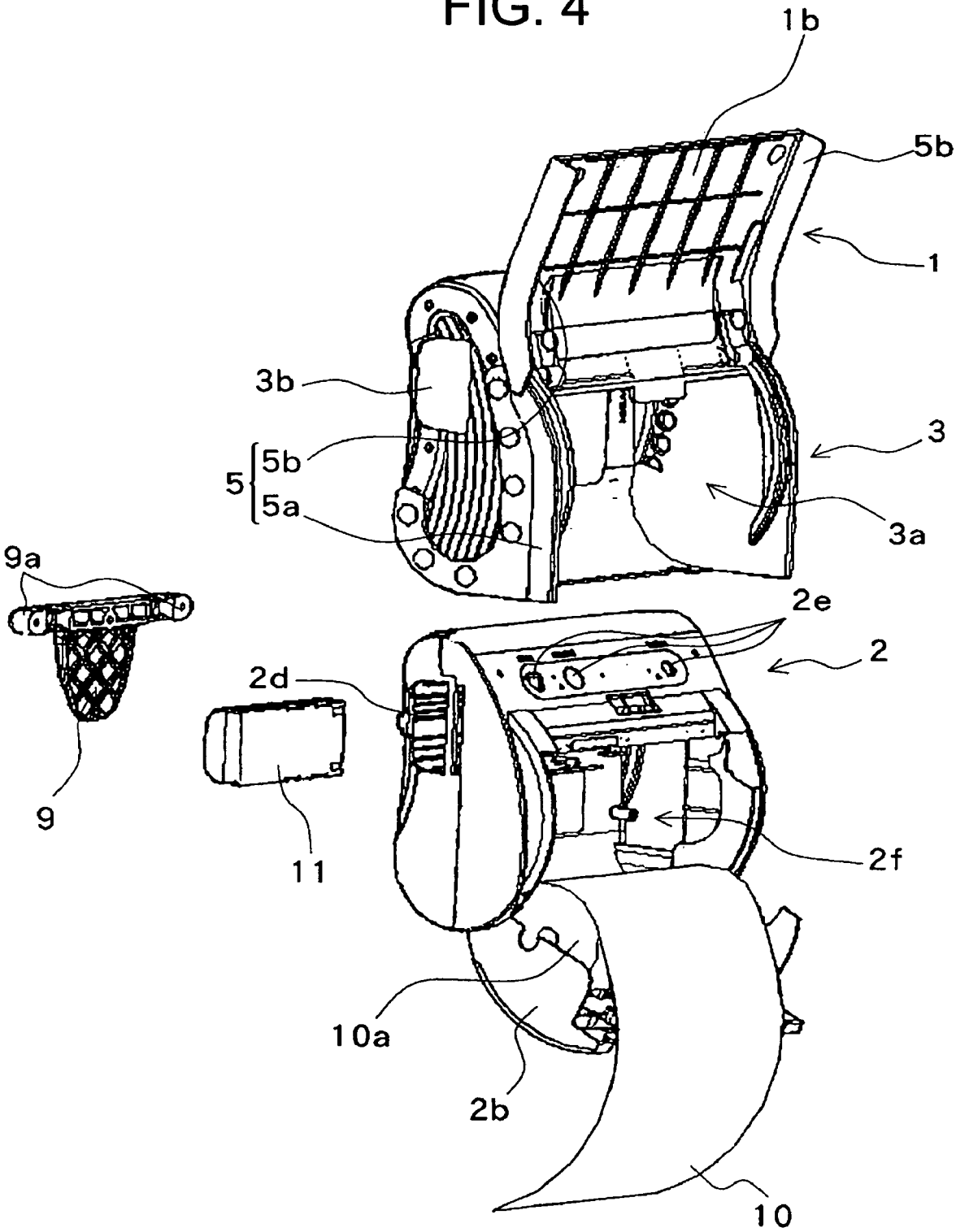
FIG. 4 is an exploded perspective view of the recording apparatus shown in FIG. 1.
Figure 5:
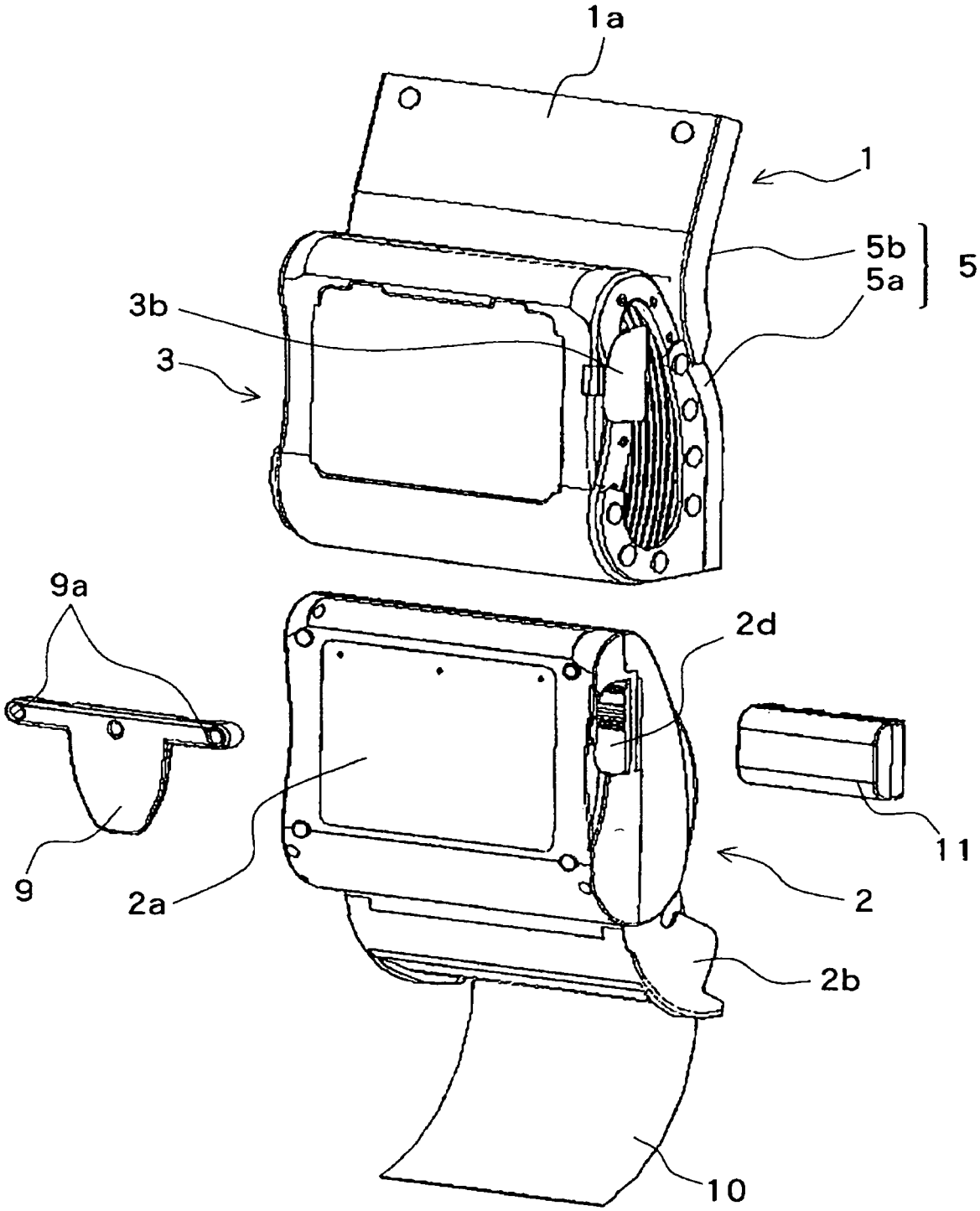
FIG. 5 is an exploded perspective view of the recording apparatus shown in FIG. 1 viewed from a direction different from that of FIG. 4.
Figure 6:
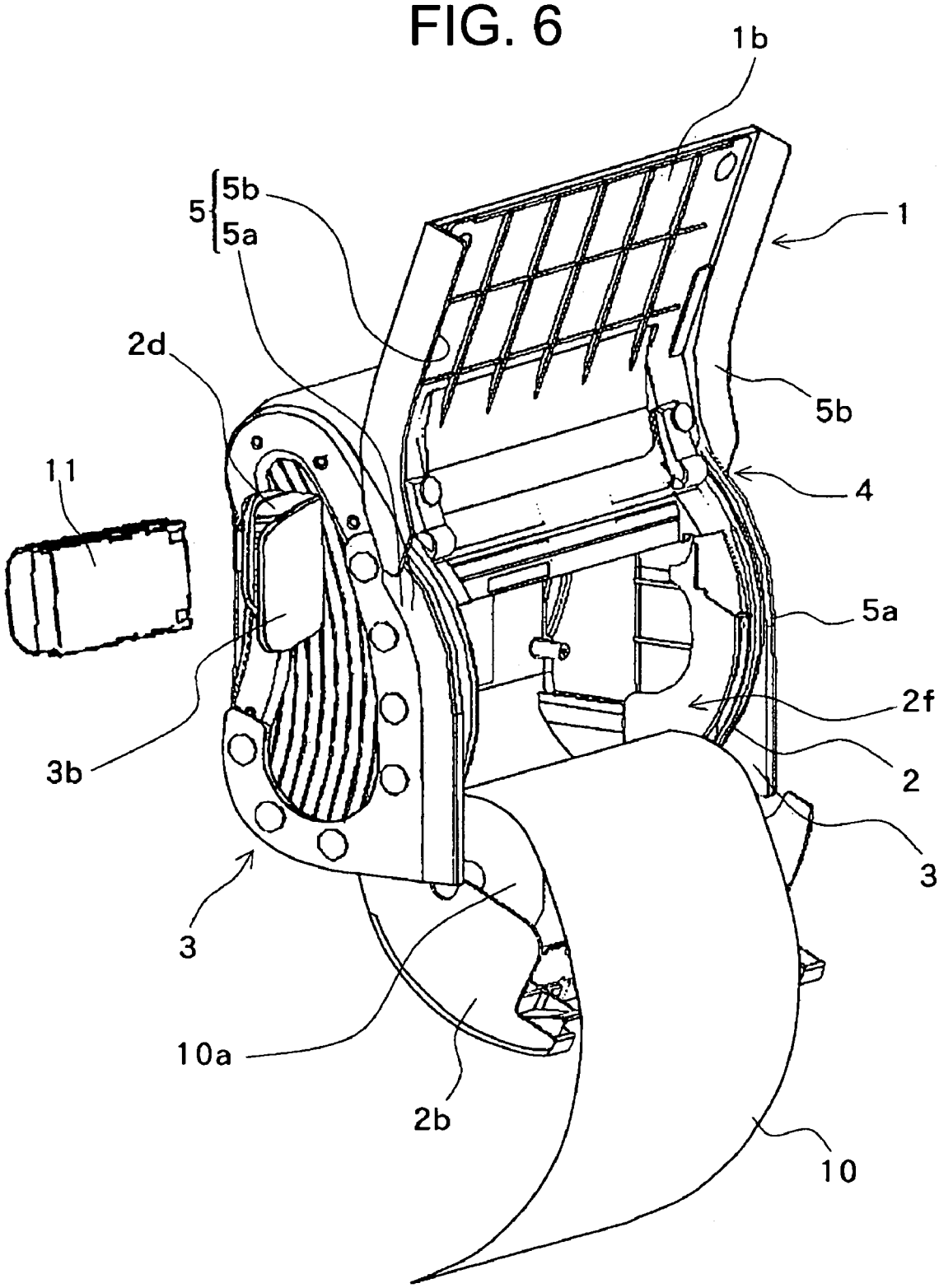
FIG. 6 is a perspective view of the recording apparatus shown in FIG. 1 showing a state where a recording medium and a battery can be attached/detached.

A recording apparatus according the present invention, which is a portable printer, is composed of a recording apparatus main body 2, a protective cover 3, and a waterproof cover 1. FIG. 1 is a perspective view of a state where the protective cover 3 and the waterproof cover 1 are mounted to the recording apparatus main body 2. FIG. 2 is a plan view of the state shown in FIG. 1. FIG. 3 is a sectional view taken along the line A-A of FIG. 2. FIGS. 4 and 5 each are an exploded view of a state where the protective cover 3 and the waterproof cover 1 are detached from the recording apparatus main body 2. Note that, FIGS. 1 to 3 each show a state where the waterproof cover 1 is closed. FIGS. 4 and 5 each show a state where the waterproof cover 1 is opened. FIG. 6 shows a state where the protective cover 3 and the waterproof cover 1 are mounted to the recording apparatus mainbody 2 and the waterproof cover 1 is opened.

First, a description is made of the recording apparatus main body 2 which is covered with the protective cover 3 and the waterproof cover 1 according to this embodiment. The recording apparatus main body 2 can be used as a stationary type. When being used as the stationary type, the recording apparatus main body 2 is laid on a bottom surface 2*a* thereof (refer to FIGS. 3 and 5) on an installation surface of a floor, a desk, or the like at a time of use. As shown in FIG. 3, the recording apparatus main body 2 can accommodate a roll body 10*a* formed of a recording medium 10 such as continuous forms paper. A casing of the recording apparatus main body 2 contains therein a conveying portion including a platen roller 7 for conveying the recording medium 10 which is fed from the roll body 10*a* and a recording portion 8 including a recording head such as a thermal head for effecting recording on the recording medium 10. The casing also has an outlet 2*c* for discharging the recording medium 10 on which recording has been effected. With this construction, it is possible to subsequently feed the recording medium 10 from the roll body 10*a* accommodated in the casing, record a predetermined image on the recording medium 10, and discharge the recording medium 10 from the outlet 2*c*. Note that, the image herein collectively refers to colored portions of characters, symbols, figures, patterns, and the like. The recording apparatus main body 2 is provided with an opening/closing portion 2*b* which can be opened/closed. FIGS. 1 to 3 each show a state where the opening/closing portion 2*b* is closed. FIGS. 4 to 6 each show a state where the opening/closing portion 2*b* is opened.

Further, the outlet 2*c* is provided adjacent to the opening/closing portion 2*b*. To be specific, an end surface of the opening/closing portion 2*b* constitutes an end surface of the outlet 2*c*. That is, in a state where the opening/closing portion 2*b* is closed, there is formed a slight space between the end surface of the opening/closing portion 2*b* and an end surface of the casing opposed there to, the space constituting the outlet 2*c*. The recording medium 10 on which recording is effected by the recording portion 8 in the recording apparatus main body 2 is discharged to the outside of the recording apparatus main body 2 from the outlet 2*c*. In a state where the opening/closing portion 2*b* is opened, the outlet 2*c* and the vicinity thereof (including a recording medium loading portion 2*f*) are exposed to the outside. Therefore, it is possible to perform various maintenance operations for the recording apparatus main body 2, such as an operation of removing the recording medium 10 to eliminate a jam (paper jam) of the recording medium 10, charging and replacement of the recording medium 10, and charging and replacement of recording ink, or the like. Further, as shown in FIGS. 4 to 6, the recording apparatus main body 2 is provided with a battery loading portion 2*d* to which a battery 11 is inserted, and obtains a driving force from a battery 11.

As shown in FIGS. 1 and 2, the recording apparatus main body 2 is provided with operating portions 2*e* by which a user gives instructions for power on/off, sheet feeding, and re-recording. The operating portions 2*e* include three switch buttons. Around each of the operating portions 2*e*, there is provided some play in the form of a gap for ensuring smooth movements of the operating portions 2*e*.

The recording apparatus main body 2 is covered with the protective cover 3 and the waterproof cover 1. The protective cover 3 and the waterproof cover 1 are connected to each other through a first connecting portion 4 and a second connecting portion 5, and cover an outer surface of the recording apparatus main body 2 except for a gap 6 positioned at a lower portion of FIGS. 1 to 3. A structure of each of the protective cover 3 and the waterproof cover 1 is described in detail below.

The protective cover 3 according to this embodiment is formed of a waterproof silicone resin, and is formed to have a certain degree of thickness so as to have shock absorption, but is flexible. The protective cover 3 has an opening 3*a* of FIG. 4. Except the opening 3*a*, the protective cover 3 is formed along the outer surface of the recording apparatus main body 2. Accordingly, when the recording apparatus main body 2 is inserted in a space inside protective cover 3, the outer surface of the recording apparatus main body 2 becomes adjacent to an inner surface of the protective cover 3 to be brought into close contact therewith. Attached to both side surfaces of the protective cover 3 is a hook-and-loop fastener 5*a* (refer to FIGS. 4 to 6) described later constituting the second connecting portion 5 for connecting the waterproof cover 3 to the protective cover 1.

As shown in FIGS. 1 and 4 to 6, on the side surface of the protective cover 3, there is provided a lid 3*b* opposed to the battery loading portion 2*d* of the recording apparatus main body 2. The lid 3*b* can be opened/closed, and is provided with a waterproof gasket (not shown) attached to an outer peripheral portion of an inner surface thereof. Accordingly, in the opened state, the lid 3*b* allows the battery loading portion 2*d* of the recording apparatus main body 2 to be exposed to the outside, and in the closed state, the lid 3*b* prevents moisture from entering the battery loading portion 2*d*.

As shown in FIGS. 1 and 2, the protective cover 3 is provided with holes 3*c* respectively opposed to the operating portions 2*e* of the recording apparatus main body 2. Due to the provision of the holes 3*c*, even in a state where the protective cover 3 is mounted to the recording apparatus main body 2, smooth movements of the operating portions 2*e* can be ensured, and the user can view the operating portions 2*e*.

The waterproof cover 1 according to this embodiment is composed of, as show in FIGS. 1 to 3, a flexible film portion 1*a* formed of transparent waterproof urethane, and a rigid guide portion 1*b* having a plate-like shape and formed of polycarbonate, polyethylene terephthalate, or the like. The film portion 1*a* is fixed and mounted to one of the end portions of the opening 3*a* of the protective cover 3 so as not to be detachable by welding, adhesion, or the like. In FIGS. 2 and 3, boundaries of a fixing portion are shown by chain double-dashed lines. The fixing portion is referred to as the first connecting portion 4. Further, the film portion 1*a* is provided with a hook-and-loop fastener 5*b* (refer to FIGS. 4 to 6) corresponding to the hook-and-loop fastener 5*a*. The two hook-and-loop fasteners 5*a* and 5*b* constitute the second connecting portion 5 for connecting the protective cover 3 and the waterproof cover 1 to each other.

As shown in FIGS. 1 and 2, in the vicinity of the first connecting portion 4, extension portions 1*c* for covering the operating portions 2*e* and the holes 3*c* when the protective cover 3 and the waterproof cover 1 are mounted to the recording apparatus main body 2. An outer peripheral portions of the extension portions 1*c* are fixed and mounted to the protective cover 3. Further, attached to an inner side of the film portion 1*a* is the rigid guide portion 1*b* having the plate-like shape. As shown in FIG. 3, an inner surface of the guide portion 1*b* is curved smoothly, and when the protective cover 3 and the waterproof cover 1 are mounted to the recording apparatus main body 2, serves as a guide for smoothly guiding the recording medium 10 from the outlet 2*c* of the recording apparatus main body 2 to the gap 6 described later.

While being connected via the first connecting portion 4, the protective cover 3 and the waterproof cover 1 are integrated with each other. Further, when the second connecting portion 5 is in a connected state as shown in FIGS. 1 to 3, the waterproof cover 1 partially covers the opening 3*a* of the protective cover 3. However, there is formed the gap 6 between the waterproof cover 1 and the protective cover 3. The gap 6 is formed of a part of the opening 3*a* and is positioned in the lower portion of FIGS. 1 and 2. In this manner, the protective cover 3 and the waterproof cover 1 constitute a waterproof cover body for covering the outer surface of the recording apparatus main body 2 having a portion exposed to the outside through the gap 6, the gap 6 being positioned in the lower portion. Connections in the first connecting portion 4, the second connecting portion 5, and the outer peripheral portions of the extension portions 1*c* are realized in a tight manner, such that moisture is prevented from entering the recording apparatus. The second connecting portion 5 is composed of the hook-and-loop fasteners 5*a* and 5*b*. Therefore, the second connecting portion 5 can easily become in the disconnected state. When the second connecting portion 5 is in the disconnected state, the waterproof cover 1 pivots about the first connecting portion 4 while being connected to the protective cover 3 through the first connecting portion 4 to be opened/closed between a position which is partially opposed to the opening 3*a* (state of FIGS. 1 to 3) and a position not opposed to the opening 3*a* (state of FIGS. 4 to 6).

In this embodiment, there is provided a strap holder 9 (refer to FIGS. 3 to 5) which is an example of a holder for carrying the recording apparatus. The strap holder 9 is attached to the bottom surface 2*a* (refer to FIGS. 3 to 5) of the recording apparatus main body 2 through an intermediation of the protective cover 3. The strap holder 9 includes attachment portions 9*a* to which a belt or a strap (not shown) to be put on a body of the user, for example, a belt to be wrapped around a waist or a strap to be carried on a shoulder is attached. In this embodiment, the strap holder 9 is attached to the bottom surface 2*a* of the recording apparatus main body 2 through the intermediation of the protective cover 3 sandwiched therebetween. Using screws or the like (not shown), the strap holder 9 is fixed to the bottom surface 2*a* of the recording apparatus main body 2 through the intermediation of the protective cover 3. In a case where the user carries the recording apparatus main body using the strap holder 9, an orientation of the recording apparatus main body 2 is continuously maintained vertical as shown in FIGS. 1 to 6.

In a case of constituting the waterproof structure by combining components described above, first, the recording apparatus main body 2 is inserted in the protective cover 3. To be specific, in a state, as shown in FIGS. 4 to 5, where the waterproof cover 1 connected to the protective cover 3 through the first connecting portion 4 is opened (state where the waterproof cover 1 is held in a position which is not opposed to the opening 3*a*), while the flexible protective cover 3 is bent by hands so that the opening 3*a* is pushed outwards to expand, the recording apparatus main body 2 is inserted into the protective cover 3 from the opening 3*a*. At this time, unlike the case shown in FIGS. 4 and 5, the opening/closing portion 2*b* of the recording apparatus main body 2 is closed. Except the opening 3*a*, the protective cover 3 is formed along an outer shape of the recording apparatus main body 2. Therefore, the outer surface of the recording apparatus main body 2 is brought into close contact with the inner surface of the protective cover 3. As described above, the recording apparatus main body 2 is fitted into an inside of the protective cover 3. Here, as shown in FIGS. 1 to 3, the waterproof cover 1 is closed (the waterproof cover 1 is moved to a position which is not partially opposed to the opening 3*a*). Then, connection is performed in the second connecting portion 5. That is, the hook-and-loop fasteners 5*a* and 5*b* (refer to FIGS. 4 to 6) are fixed to each other.

Next, using the screws or the like (not shown), the strap holder 9 is fixed to the bottom surface 2*a* of the recording apparatus main body 2 through the intermediation of the protective cover 3. As a result, the user can carry the recording apparatus while holding the recording apparatus main body 2 using the strap holder 9 and the strap or the like (not shown). Note that, in some usage, the strap holder 9 may not necessarily be attached.

In this manner, the recording apparatus main body 2 is covered with the protective cover 3 and the waterproof cover 1, while a portion opposed to the gap 6 positioned in the lower portion is not covered to be exposed to the outside. As described above, in the case where the recording apparatus main body 2 is held using the strap holder 9, the orientation of the recording apparatus main body 2 is constant and the gap 6 is continuously positioned in the lower portion. Accordingly, in the state where the protective cover 3 and the waterproof cover 1 are mounted to the recording apparatus main body 2, moisture does not enter the recording apparatus main body 2 from the gap 6 unless moisture erupts upwardly from below. That is, in a normal use environment, a sufficient waterproof effect can be obtained due to the protective cover 3 and the waterproof cover 1. Therefore, even outdoors in the rain, it is possible to use the recording apparatus without wetting the recording apparatus main body 2. Thus, the recording apparatus main body 2 does not require a special waterproof structure.

With the use of the recording apparatus main body 2, the recording medium 10 on which recording is effected is discharged from the outlet 2*c*. According to this embodiment, as shown in FIG. 3, the recording medium 10 discharged from the outlet 2*c* is guided by the inner surface (curved surface) of the guide portion 1*b* and is introduced to the lower portion along the curved surface of the guide portion 1*b* to be discharged from the gap 6 to the outside. That is, according to this embodiment, without opening the waterproof cover 1, it is possible to discharge the recording medium 10 from the recording apparatus main body 2. The gap 6 is positioned in the lower portion as described above, so there is no possibility of the waterproof effect being lost due to the gap 6 for discharging the recording medium 10.

As shown in FIGS. 1 and 2, the recording apparatus main body 2 is provided with the operating portions 2*e*, and the protective cover 3 is provide with the holes 3*c* for allowing the operating portions 2*e* to be exposed to the outside. In this embodiment, in order to prevent moisture from entering the inside the recording apparatus main body 2 from the spaces around the operating portions 2*e* through the holes 3*c*, the waterproof film 1*a* of the waterproof cover 1 is extended and with the resultant extension portions 1*c*, the holes 3*c* and the operating portions 2*e* are covered. Further, the outer peripheral portions of the extension portions 1*c* are fixed and mounted to the protective cover 3 by welding or adhesion, thereby realizing a high waterproof effect. The film portion 1*a* of this embodiment is transparent and flexible, so the user can view the operating portions 2*e* and display portions around those through the extension portions 1*c* and can perform operation by pushing the operating portions 2*e* through the extension portions 1*c*.

As shown in FIG. 3, the recording apparatus main body 2 is tightly covered with the protective cover 3 formed along the outer shape of the recording apparatus main body 2 and having shock absorption. Therefore, the impact at the time of fall, abutment with other articles, or the like can be absorbed by the protective cover 3, thereby making it possible to prevent the recording apparatus main body 2 from being damaged. Further, the recording apparatus main body 2 does not move (rattle) inside the protective cover 3, so the recording apparatus main body 2 is not damaged due to the impact inside the protective cover 3. Note that, though a space exists between the recording apparatus main body 2 and the waterproof cover 1, the recording apparatus main body 2 does not move (rattle) so as to come into contact with and be spaced apart from the waterproof cover 1. This is because a major part of the recording apparatus main body 2 is held by the protective cover 3. While in the gap 6 positioned in the lower portion, the recording apparatus main body 2 is exposed to the outside, there is considered to be a substantially low possibility of foreign articles passing through the gap 6 in the lower portion to cause damage by directly abutting on the recording apparatus main body 2. Thus, it can be said that an effect of being capable of suppressing damages of the recording apparatus main body 2 due to the structure of this embodiment is extremely large.

As described above, in the recording apparatus main body 2 covered with the waterproof cover 1 and the protective cover 3, in a case of performing maintenance operations such as elimination of a jam of the recording medium 10, charging and replacement of the recording medium 10, and charging and replacement of the recording ink or the like, the second connecting portion 5 is changed into the disconnected state. That is, the hook-and-loop fastener 5*b* is removed from the hook-and-loop fastener 5*a*. As a result, the waterproof cover 1 becomes capable of opening/closing with respect to the protective cover 3. Here, the waterproof cover 1 is opened (moved to the position not opposed to the opening 3*a*). As a result, the opening/closing portion 2*b* of the recording apparatus main body 2 is exposed to the outside. When the opening/closing portion 2*b* is further opened, the recording medium loading portion 2*f* is exposed to the outside as shown in FIG. 6. Thus, the user can insert the hands into the recording medium loading portion 2*f* and the vicinity thereof, thereby making it possible to perform various maintenance operations such as elimination of the jam of the recording medium 10, charging and replacement of the recording medium 10, and charging and replacement of the recording ink or the like. At this time, the waterproof cover 1 is connected to the protective cover 3 through the first connecting portion 4 (fixing portion). Therefore, there is no need for the waterproof cover 1 to be stored in another place during the operation or to be held by the user. Further, the waterproof cover 1 constitutes no obstacle to holding or the maintenance operations of the recording apparatus main body 2. In particular, in the case where the recording apparatus main body 2 is put on the body using the strap holder 9 and a strap (not shown), the user can use both hands to perform an operation. As described above, the operability of maintenance or the like by the user is remarkably excellent.

After completion of the maintenance or the like, the opening/closing portion 2*b* of the recording apparatus main body 2 is closed and the waterproof cover 1 is closed (returned to the position in which the opening 3*a* is partially covered). Then, the second connecting portion 5 is made to be in a connected state. That is, the hook-and-loop fastener 5*b* is fixed to the hook-and-loop fastener 5*a*. In this manner, the recording apparatus main body can be returned to a waterproof state shown in FIGS. 1 to 3.

In this embodiment, as the second connecting portion 5, the hook-and-loop fasteners 5*a* and 5*b* are adopted. Therefore, as described above, for the maintenance operations, operations of opening and closing the waterproof cover 1 can be performed extremely easily. This is because the hook-and-loop fasteners 5*a* and 5*b* can be tightly connected to each other even when relative positions of those are not accurately corresponding to each other. Further, the hook-and-loop fasteners 5*a* and 5*b* are effective because there is extremely low possibility of moisture entering inside the covers through connection portions of the hook-and-loop fasteners 5*a* and 5*b*. On the other hand, the first connecting portion 4 of this embodiment constitutes a fixing portion which cannot be detached due to welding or adhesion thereof. Accordingly, when the waterproof cover 1 is moved after disconnecting the hook-and-loop fasteners 5*a* and 5*b* from each other, there is no risk of the waterproof cover 1 being detached to fall off.

In this embodiment, as described above, the first connecting portion 4 constitutes the fixing portion and the second connecting portion 5 is composed of the hook-and-loop fasteners 5*a* and 5*b*, thereby making it possible to form the waterproof structure which is excellent in operability and reliability. The first connecting portion 4 of the present invention is not limited to the fixing portion, and can adopt various connecting mechanisms as long as the connecting mechanism has high waterproof characteristics and a structure in which connection is not easily canceled. Further, the second connecting portion 5 of the present invention is not limited to the hook-and-loop fastener 5*a* and 5*b*, and can adopt various connecting mechanisms as long as the connecting mechanism has high waterproof characteristics and a structure in which connection can be easily canceled, for example, magnet tapes or snap fasteners (hooks).

In this embodiment, when the battery 11 is attached/detached, the waterproof cover 1 can be left closed. That is, as shown in FIG. 6, by opening the lid 3*b* provided to the side surface of the protective cover 3, the battery loading portion 2*d* of the recording apparatus main body 2 can be exposed to the outside. Here, the user attach/detach the battery 11 to/from the battery loading portion 2 with ease. After completion of the attachment/detachment of the battery 11, by closing the lid 3*b*, the recording apparatus can easily return to the waterproof state shown in FIGS. 1 to 3. Note that, in FIG. 6, for convenience, a state where the lid 3*b* is opened, while the waterproof cover 1 and the opening/closing portion 2*b* are opened. However, in reality, when performing attachment/detachment of the battery 11, it suffices that only the lid 3*b* is opened while the waterproof cover 1 and the opening/closing portion 2*b* are left closed. Further, when performing the operation such as elimination of the jam of the recording medium 10, charging and replacement of the recording medium 10, or charging and replacement of the recording ink or the like, it suffices that the waterproof cover 1 and the opening/closing portion 2 are opened while the lid 3*b* is left closed.

Further, in this embodiment, on the inner surface of the waterproof cover 1, there is provided the guide portion 1*b* for guiding the recording medium 10 to the gap 6. Therefore, it is possible to smoothly discharge the recording medium 10 to the outside from the gap 6 of the waterproof cover 1 regardless of the position of the outlet 2*c* of the recording apparatus main body 2 or a discharge direction of the recording medium 10. In the exemplary drawings, there is provided the gap 6 which allows about a half of one surface (lower surface in FIGS. 1 to 3) of the recording apparatus main body 2 to be exposed to the outside. However, the gap 6 can be made smaller by further bending the waterproof cover 1.

As described above, according to this embodiment, when the protective cover 3, to which the waterproof cover 1 is connected via the first connecting portion 4 so as not to be detachable, is kept attached to the recording apparatus main body 2, various operations can be performed without any trouble. The various operations include the operations of the operating portions 2*e*, discharge of the recording medium 10, the maintenance operations such as attachment/detachment of the recording medium 10 and elimination of the paper jam of the recording medium 10, and attachment/detachment of the battery 11. Further, the protective cover 3 is formed substantially along the outer shape of the recording apparatus main body 2. In the state where the waterproof cover 1 is closed, the outer shape of the entire recording apparatus including the waterproof cover 1 and the protective cover 3 is only a size larger than the recording apparatus main body 2. Therefore, a shape and a size of the recording apparatus are almost the same as the recording apparatus main body 2. Accordingly, unless a special trouble occurs such as a failure of the recording apparatus main body 2, the recording apparatus can be used without detaching the protective cover 3 from the recording apparatus main body 2, that is, while the protective cover 3 is kept attached thereto. In other words, the recording apparatus can be used as a single product in a state where the protective cover 3 to which the waterproof cover 1 is connected is attached to the recording apparatus main body 2 (states shown in FIGS. 1 to 3 and 6). With this structure, the recording apparatus can be easily used without a sense of discomfort as compared to the structure in which, only when there is a need for the waterproof characteristics of the recording apparatus, the waterproof cover as an attachment is attached to the recording apparatus which is the single product and when there is no need for the waterproof characteristics, the waterproof cover is detached.

Note that, an object to be protected by the waterproof structure composed of the waterproof cover 2 and the protective cover 3 according to the present invention is not limited to a single function printer, and can be various recording apparatuses each having a recording portion for effecting printing on a recording medium. For example, the recording apparatus may be one having communication mechanism, measuring mechanism, calculating mechanism, and the like as well as the recording portion and used for various applications. In particular, the present invention is highly effective for the recording apparatus which may be used outside in the rain. Note that, in the specification, all the apparatuses each having the recording portion for effecting recording on the recording medium is collectively called "recording apparatus".

What is claimed is:

1. A recording apparatus, comprising:

a recording apparatus main body having a recording portion for effecting recording on a recording medium and an outlet for discharging the recording medium;

a protective cover which is formed of a waterproof material and which has an opening, the protective cover covering the recording apparatus main body with a portion thereof other than the opening of the protective cover; and a waterproof cover which is formed of a waterproof material and which is connected to the protective cover via a first connecting portion and a second connecting portion;

wherein, when the first connecting portion and the second connecting portion are respectively in connected states, the waterproof cover is positioned so that the waterproof cover is partially opposed to the opening of the protective cover, the protective cover and the waterproof cover are provided with a gap therebetween through which the recording medium can pass, and the waterproof cover and the protective cover jointly cover an outer surface of the recording apparatus main body with a portion of the recording main body exposed to the outside through the gap, and when the first connecting portion is in the connected state and the second connecting portion is in a disconnected state, the waterproof cover is moved to a position not opposed to the opening so that a part of the recording apparatus main body is exposed to the outside through the opening; and wherein the recording apparatus main body is provided with operating portions, the protective cover has a hole that opens in a position which is opposed to the operating portions, and the waterproof cover has an extension portion that closes the hole.

2. A recording apparatus, comprising:

a recording apparatus main body having a recording portion for effecting recording on a recording medium and an outlet for discharging the recording medium;

a protective cover which is formed of a waterproof material and which has an opening, the protective cover covering the recording apparatus main body with a portion thereof other than the opening of the protective cover; and a waterproof cover which is formed of a waterproof material and which is connected to the protective cover via a first connecting portion and a second connecting portion;

wherein, when the first connecting portion and the second connecting portion are respectively in connected states, the waterproof cover is positioned so that the waterproof cover is partially opposed to the opening of the protective cover, the protective cover and the waterproof cover are provided with a gap therebetween through which the recording medium can pass, and the waterproof cover and the protective cover jointly cover an outer surface of the recording apparatus main body with a portion of the recording main body exposed to the outside through the gap, and when the first connecting portion is in the connected state and the second connecting portion is in a disconnected state, the waterproof cover is moved to a position not opposed to the opening so that a part of the recording apparatus main body is exposed to the outside through the opening; and wherein the waterproof cover includes a guide portion for guiding the recording medium discharged from the outlet to the gap.

3. A recording apparatus, comprising:

a recording apparatus main body having a recording portion for effecting recording on a recording medium and an outlet for discharging the recording medium;

a protective cover which is formed of a waterproof material and which has an opening, the protective cover covering the recording apparatus main body with a portion thereof other than the opening of the protective cover;

a holder attached to an outer side of the protective cover for carrying the recording apparatus main body; and a waterproof cover which is formed of a waterproof material and which is connected to the protective cover via a first connecting portion and a second connecting portion;

wherein, when the first connecting portion and the second connecting portion are respectively in connected states, the waterproof cover is positioned so that the waterproof cover is partially opposed to the opening of the protective cover, the protective cover and the waterproof cover are provided with a gap therebetween through which the recording medium can pass, and the waterproof cover and the protective cover jointly cover an outer surface of the recording apparatus main body with a portion of the recording apparatus main body exposed to the outside through the gap, and when the first connecting portion is in the connected state and the second connecting portion is in a disconnected state, the waterproof cover is moved to a position not opposed to the opening so that a part of the recording apparatus main body is exposed to the outside through the opening; and wherein the gap is provided in a position located on a lower side of the recording apparatus main body when the recording apparatus main body is covered with the protective cover and the waterproof cover and is carried using the holder.

* * * * *